US009370701B2

(12) United States Patent
Shepherd et al.

(10) Patent No.: US 9,370,701 B2
(45) Date of Patent: Jun. 21, 2016

(54) FOLDING BASKETBALL GOAL

(76) Inventors: Lawrence Shepherd, Upper Sandusky, OH (US); Lillian Jean Shepherd, Upper Sandusky, OH (US)

( * ) Notice: Subject to any disclaimer, the term of this patent is extended or adjusted under 35 U.S.C. 154(b) by 0 days.

(21) Appl. No.: 13/476,309

(22) Filed: May 21, 2012

(65) Prior Publication Data

US 2012/0252607 A1 Oct. 4, 2012

Related U.S. Application Data

(63) Continuation-in-part of application No. 13/009,139, filed on Jan. 19, 2011, now abandoned.

(51) Int. Cl.

| | |
|---|---|
| ***A63B 63/08*** | (2006.01) |
| *A63B 71/02* | (2006.01) |
| *A63B 67/04* | (2006.01) |
| *A47B 83/02* | (2006.01) |

(52) U.S. Cl.

CPC ..... *A63B 63/083* (2013.01); *A47B 83/02* (2013.01); *A63B 67/04* (2013.01); *A63B 2071/026* (2013.01); *A63B 2207/02* (2013.01); *A63B 2210/02* (2013.01); *A63B 2210/56* (2013.01); *A63B 2243/0037* (2013.01); *A63B 2243/0091* (2013.01)

(58) Field of Classification Search

USPC ..... 473/481, 479, 482, 480, 483

See application file for complete search history.

(56) References Cited

U.S. PATENT DOCUMENTS

| | | | | |
|---|---|---|---|---|
| 2,358,883 | A * | 9/1944 | Rothschild | 190/12 R |
| 3,716,234 | A * | 2/1973 | Lancellotti | 473/481 |
| 3,841,631 | A | 10/1974 | Dolan | |
| 3,993,004 | A | 11/1976 | Alme | |
| 4,424,604 | A * | 1/1984 | Dupuis | 16/29 |
| 5,390,914 | A | 2/1995 | Schroeder | |
| 5,470,057 | A | 11/1995 | Bodford, Jr. | |
| 5,542,679 | A | 8/1996 | Caso | |
| 5,599,016 | A * | 2/1997 | Larkin | 473/448 |
| 5,628,508 | A | 5/1997 | Koole | |
| 5,655,979 | A | 8/1997 | Blue | |

(Continued)

FOREIGN PATENT DOCUMENTS

GB 2 330 775 A 5/1999

OTHER PUBLICATIONS

Webpage download, DesktopBasketball, 2010,www.sz-wholesale.com/shenzhen_China_products/Desktop-Basketball-Game_1.htm,. 6 pages.*

*Primary Examiner* — Gene Kim
*Assistant Examiner* — M Chambers
(74) *Attorney, Agent, or Firm* — Okuley Smith LLC

(57) ABSTRACT

The invention disclosed is a foldable basketball goal apparatus that is usable as a basketball goal for playing the game of basketball in the active position. When in the folded, home position, the apparatus is usable as a sports table or for other activities requiring a table. The apparatus is made of a base, a frame assembly, and a basketball goal assembly. The basketball goal assembly is rotatable and slidable with respect to the frame assembly. The frame assembly is pivotally attached to the base. In the home position, the frame assembly is lowered to rest on the base and the basketball goal assembly is rotated 180 degrees and retracted beneath the table surface. A frame assembly partial table surface forms a complete table surface when in the home position, mated with base table surface portions. The rim is protected within the base structural frame when in the home position.

20 Claims, 9 Drawing Sheets

(56) References Cited

U.S. PATENT DOCUMENTS

| | | | | |
|---|---|---|---|---|
| 5,718,475 | A * | 2/1998 | Watts | 297/127 |
| 5,772,167 | A | 6/1998 | Koole | |
| 6,082,386 | A | 7/2000 | Zheng | |
| 6,405,990 | B2 | 6/2002 | Davis et al. | |
| 6,432,003 | B1 | 8/2002 | Van Nimwegen | |
| 6,926,020 | B2 | 8/2005 | Zheng | |
| 7,118,500 | B2 | 10/2006 | Nye et al. | |
| 7,431,672 | B2 | 10/2008 | Van Nimwegen | |
| 7,509,695 | B2 | 3/2009 | Zheng | |
| 2004/0140622 | A1 | 7/2004 | Giegerich et al. | |
| 2012/0252607 | A1 * | 10/2012 | Shepherd et al. | 473/483 |

* cited by examiner

FOLDING BASKETBALL GOAL

CROSS-REFERENCE TO RELATED APPLICATIONS

This application is a continuation-in-part of, and claims the benefit of, the U.S. patent application Ser. No. 13/009,139 filed Jan. 19, 2011, the disclosure of which is expressly incorporated herein by reference.

STATEMENT REGARDING FEDERALLY SPONSORED RESEARCH

None.

BACKGROUND OF THE INVENTION

The present invention relates generally to the design and configuration of mechanical devices, and more specifically to a foldable, two-mode basketball goal and sports table apparatus.

Many basketball systems are available to consumers who have a need for a basketball goal system that is mobile, or one that has the ability to be stored when not being used. Some consumers may require a basketball goal that is adjustable in height. Currently, systems range from the relatively inexpensive to elaborate and robust high quality systems. Often, high quality basketball hoops need to be stored indoors to protect them from the elements and prolong their useful life. Some consumers may also wish to have a basketball goal system available when needed, but do not wish to install such systems permanently. Some situations may not allow for the installation of permanent hoops, such as those wishing to use them at a gym, where multiple basketball goals are needed during team practices, but are removed for intersquad games. Local zoning ordinances or temporary residence circumstances can also contribute to a desire for the temporary installation of a basketball goal system.

Simple prior art systems provide for portable basketball goals, such as U.S. Pat. No. 3,025,058 to Brumfield and U.S. Pat. No. 3,722,886 to Sinner. The Brumfield patent is a basic design having a basketball goal supported by a support pole that is in turn connected to a base. The base is configured such that the entire system can be tilted backwards onto wheels affixed to the base. Thus, by holding onto the support pole, a user can push or pull the system, to move it to another desired location. Similarly, Sinner's '886 patent discloses a set of wheels for the base of the system, with the support pole extending backwards from the goal to the ground, where it can be fixed to the floor. By detaching the support pole from the floor, the Sinner system can be moved to other desired locations. Also, while these systems are useful, they do not provide robust and lasting systems that can generally withstand weathering and heavy use.

The portable systems described above are not optimized for storage, however. Largely devoid of the ability to collapse into a smaller volume, the space taken up by these and similar systems cannot be substantially reduced. Users may wish for a basketball goal system to be portable, not because they wish to deploy the system in multiple locations, but so that it can be stored while not in use. Because storage spaces are often small and basketball goal systems are large and bulky, it is desirable that said systems be collapsible as well as portable. For example, U.S. Pat. No. 3,841,631 to Dolan discloses a simple portable basketball goal system that can be assembled and disassembled. The ability to disassemble a basketball goal into smaller components is useful for mobility and for storing the device. The Dolan patent discloses a portable basketball backstop construction that utilizes a liquid-filled base member, detachable support post sections, and a backboard and hoop component to allow users to erect a freestanding basketball goal system. Disassembling the components of the Dolan system allows for compact storage and increases the portability of the device. When disassembled, however, the separate component pieces provide no individual functionality when in this state.

In lieu of a system that may be easily disassembled into component parts, others have developed basketball goal systems that remain assembled, but fold into more compact positions for transporting or storing. For example, U.S. Pat. Nos. 5,628,508 and 5,772,167 to Koole disclose a foldable basketball goal stand. Incorporating a basic four-bar structure between a basketball goal support and a base stand, springs allow the support to be raised to regulation height or lowered to near ground level for transportation or storage. The Koole system decreases the height of the mechanism when in the folded position, but does not decrease the footprint, or floor space taken up by the system. Other systems, such as the system disclosed in U.S. Pat. No. 5,390,914 to Schroeder, utilize a folding mechanism to ease transportation, also without significantly affecting storage size. Furthermore, much like the Dolan patent, these systems serve no functional purpose when in the folded/stored position.

Many consumers desire a basketball goal that is adjustable. While the normal height of a basketball rim is ten feet from ground level, some prefer to lower the rim for younger players, or for a change of pace. Many systems provide for an adjustable rim height, although the range of adjustable sizes and method of adjustment vary greatly.

Basketball goals similar to the Dolan system can be reduced to a relatively compact size, but are more difficult to transport. Transporting and storing several individual components is much more difficult than storing a single system that has been reconfigured into a more compact form. Many foldable basketball systems, however, do not significantly decrease the size of the folded system, such that a large area is needed for storage.

No devices are available that exhibit functionality when in a stored or folded position. Many consumers do not desire to have a permanent basketball goal installed, or do not have the requisite storage space for a storable unit. If a basketball goal had a secondary use when in its storage mode, the overall system would be more useful to consumers, and would provide year-round usefulness. Thus, there is presently an unmet and growing need for an improved basketball goal system that will fold for storage, and one that will provide for alternative uses of the system when in such a stored position.

BRIEF SUMMARY OF THE INVENTION

The present invention is embodied in an apparatus that provides a foldable basketball hoop structure that—when in the folded or home position—becomes a sports table having a tabletop and base. The system can operate using an automatic powered actuator to transition from the home position to the upright, basketball hoop, or active position, and to return to the home position as well. Likewise, the apparatus may be configured to require a human force input to traverse the positions, with force assistance provided or force multiplication utilized.

While many foldable, portable systems are available on the market, these have limited useful functions when in the folded position. It is desirable to have multiple functions available in a foldable system so that the device is useful at all times, and not just when the basketball goal is in the active, unfolded, position. The basketball hoop, backboard, and mast make up the basketball goal assembly, wherein the mast is slidably and rotatably attached within an elongate mast housing, which together with a footer frame, make up a frame assembly. The frame assembly is in turn connected to a base. The frame assembly portion of the apparatus is pivotally connected to the base at one or more lower pivot points at the end of the frame assembly comprised of the footer frame and opposite to the mounting insertion point of the basketball goal assembly. The height of the backboard and rim may be adjustable by providing multiple retaining pin holes along the mast length into which a retaining pin may be inserted, passing through one or more frame assembly retaining pin holes and thereby securing the basketball goal assembly against rotational and linear motion with respect to the frame assembly. One extended position should result in the hoop being positioned at the standard regulation height of ten feet off the ground.

To transition to the home position, the frame assembly is pivoted about the lower pivot point(s) so that the elongate mast housing is generally horizontally disposed, with the base providing support to the frame assembly. The basketball goal assembly is then oriented in a closed position, wherein the mast is rotated so that the front playing surface of the backboard is oriented in a plane parallel to a partial table surface and faces in an opposite direction of said surface, with the mast fully retracted.

To transition to the active position, the basketball goal assembly is extended by pulling the backboard to a point outside the base and is rotated 180 degrees, a retaining pin is inserted into the applicable retaining pin hole selection to set the playing height, and the frame assembly is pivoted about the lower pivot point(s) until the elongate mast housing is generally vertically disposed with the base acting as a counterweight to the frame assembly, and wherein the rim is accessible for playing basketball.

Other features of the system may include a frame assembly further comprised of a hollow shaft bushing having an internal surface, the shaft bushing being rotatably and linearly fixed with respect to the elongate mast housing by a plurality of mounting retainers positioned and spaced apart along the elongate mast housing axis. The mast can be further comprised of an external surface and mounted within the internal surface such that the mast is coaxial, slidable, and rotatable with respect to the shaft bushing, and the mast external surface and shaft bushing internal surface form a bearing surface.

Another aspect of the invention includes a telescoping supporting having a fixed portion secured to the base table structure and a telescoping portion extendable outwardly from the base table structure and having a distal end such that the distal end of the telescoping portion contacts and is securable to the frame assembly when the apparatus is in the active position, and wherein the connection of the telescoping support to the frame assembly when the apparatus is in the active position prevents rotational motion by the frame assembly about the lower pivot point(s).

Yet another aspect of the invention includes a wishbone support having left and right support members oriented in a wishbone configuration and each having a proximal end and a distal end, wherein the left support member proximal end is spaced apart from the right member proximal end, and wherein the left support member distal end is mated to the right support member distal end. The left and right support members are each securable to the base table structure and the mated left and right support member distal ends form a connection point securable to the elongate mast housing, wherein the frame assembly is buttressed against lateral forces with respect to the elongate mast housing axis when the apparatus is in the active position.

A further aspect of the invention comprises the use of a force assist mechanism connected to both the base and the frame assembly for reversibly providing force assistance when transitioning the apparatus between the home and active position, wherein the force assistance is reversible due to the availability of force in both directions of frame assembly travel. The force assist mechanism is preferably an elastic band or a plurality of elastic bands having proximal ends connected to the base and distal ends connected to the frame assembly. Alternatively, a force assist mechanism utilizing a spring tension mechanism housed within the base frame assembly, such as the base assembly disclosed in U.S. patent application Ser. No. 13/009,139, may also be desirable.

Other features of the system may include removable wheels that, when attached, allow the user to move the table-goal system to different locations, or to store the apparatus. To raise and lower the frame assembly or extend the basketball goal assembly, linear actuators or other lifting/extending or force assist mechanisms may be used. Also, when in the home position, the basketball hoop and net are hidden and protected between two table legs, removing them from harm's way and from obstructing the legs of table users. Benches can be provided with hollow cavities and removable lids thereby providing storage space inside the hollow bench for detachable wheels, support structure elements, games, and the like.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

Figure 1:
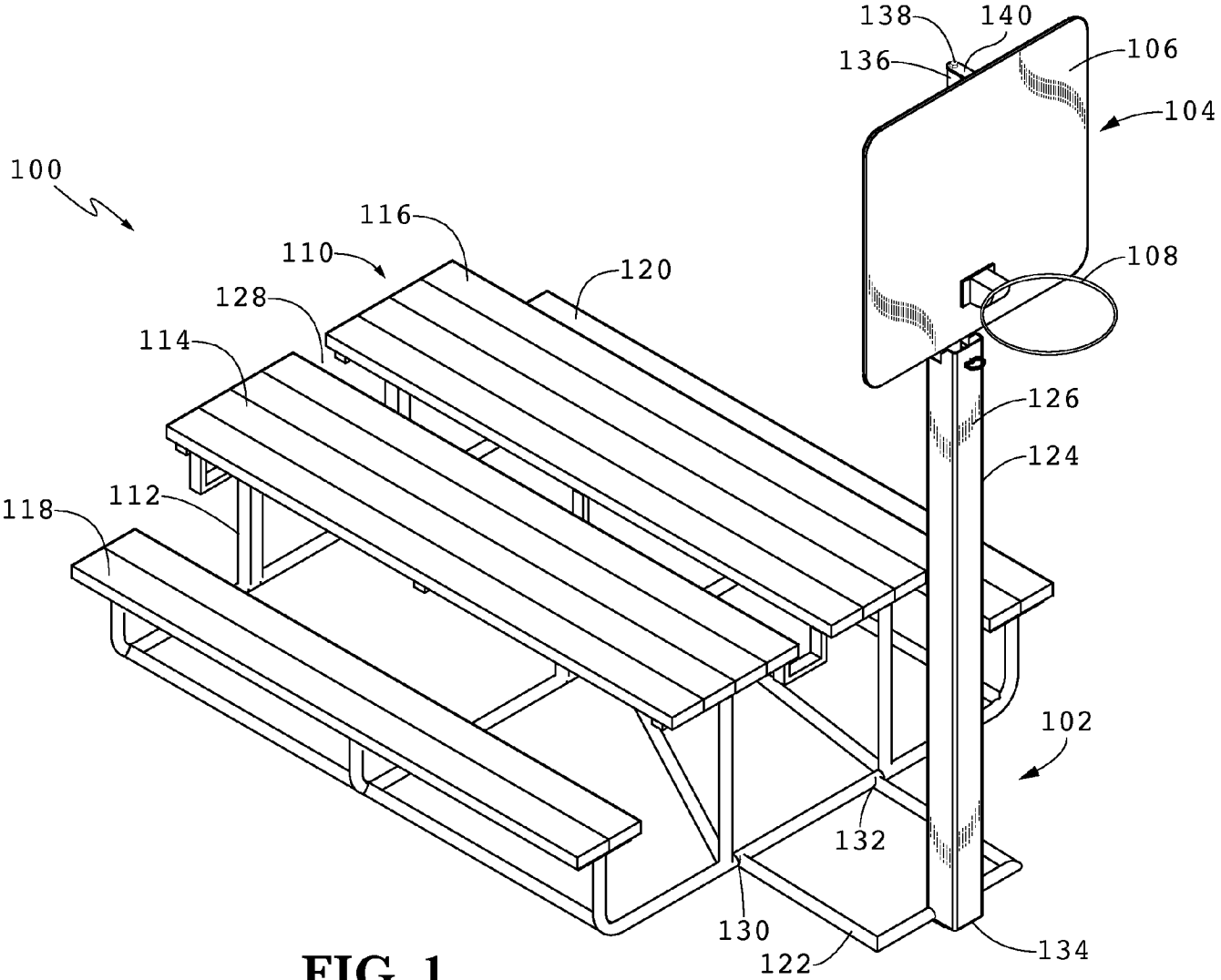
FIG. 1 shows an elevated front left perspective view of the elements of an embodiment of the invention in the active position.

Disclosed herein is a basketball goal apparatus, foldable between an active position and a home position. The main object of the invention is to provide a basketball goal system that is safe, portable, storable, foldable, compact, and useful when in a home, or folded, position (i.e., when the device is not being used as a basketball goal). The apparatus includes a basketball goal assembly slidably and rotatably connected to the upper end of a pivotable frame assembly. The basketball goal assembly includes a mast, backboard, and basketball rim, and may include other related items that may be useful to users during the use of the apparatus, such as a score indicator, lights, or time display. The frame assembly is in turn pivotally connected to a base table structure by way of its footer frame. When the base is at rest, the pivot connection between the footer frame of the frame assembly and the base does not experience translational motion. The upper end of the frame assembly experiences rotational motion about the lower pivot point when traversing the positions of the apparatus.

The apparatus has two main modes of operation, the home and active positions, in which the moveable elements are adjustable to certain positions as needed for the mode of use desired. In the home position, the frame assembly is pivoted about the pivot point with the base to bring the frame assembly to rest on the base, such that the partial table surface on the frame assembly is disposed in a generally horizontal orientation. The basketball goal assembly is rotated 180 degrees and is slid under the table surface until the mast is fully retracted into the frame assembly and the basketball goal assembly is thus hidden from view. In this position, the apparatus may be utilized as a sports table, or for any of the general purposes for which a table may be used. Users of the apparatus may, for instance, play sports games or board games on the table surface, or they may choose to use it as a picnic table. The table surface might be used as a work surface in a garage while the device is stored during the winter months in colder climates, when outdoor basketball participation ebbs, or if the apparatus is used as an indoor basketball goal, during periods of inactivity.

In the active position, the apparatus is configured for use as a basketball goal to be used by participants playing a game of basketball. This position requires the basketball goal assembly to be pulled from its resting place beneath the table surface so that the mast extends from the frame assembly until it is clear of the table footprint. The basketball goal assembly is then rotated 180 degrees and locked into place with a retaining pin, and the frame assembly is lifted from its resting position on the base, pivoting about the lower pivot point such that the elongate mast housing becomes generally vertically disposed. If desired, various support structures may be employed at this stage prior to using the apparatus for increased stability and safety. For example, a telescoping support may be extended from the base and connected to the frame assembly to buttress the frame assembly from pivoting about the lower pivot point. A wishbone support may be connected between the base table structure and the frame assembly to prevent the frame assembly from lateral rotation with respect to the plane in which it pivots.

Various element dimensions—such as the elongate mast housing length (i.e., table length) —may be used to fit the needs of those making and using the invention, as those skilled in the art will recognize. In the preferred embodiment, the basketball goal assembly should be positionable so that the rim is positioned at a height of ten feet from the basketball court floor, per usual basketball competition standards. The best mode of the invention currently employs an overall table length of approximately seven feet when the apparatus is in the home position. This table length is comparable to average table sizes, while simultaneously providing a frame assembly length that is ideal with respect to the force required to lift it to an upright position. Longer table lengths increase the input forces required to raise and lower the frame assembly by increasing the distance between the frame assembly center of gravity and the pivot point between the frame assembly and the base member, thus increasing the reactive moment at the pivot. Seven feet is a preferred table length that is well within the lifting forces supplied by typical users of the apparatus.

FIGS. 1 through 13 illustrate the basic elements of the current invention and the interrelation of the elements in the transition between the apparatus's two modes of operation. FIG. 1 shows an embodiment of the apparatus 100 in the active position, wherein the frame assembly 102 is generally vertically oriented and the basketball goal assembly 104 is generally oriented so that it is available to users who wish to play basketball, with the backboard 106 and rim 108 facing away from the base table structure 110.

The base table structure 110 is made of a frame portion 112 onto which portions of a table surface 114 and 116 are affixed. The use of lightweight and hollow plastic slats to create table surface portions 114 and 116 are preferred because of their low weight and durability, but any material suitable for use as a table surface may be used without departing from the teachings of the invention. For example, metal, wood, alloy, or natural materials such as cork may also be used. The table surface portions may also be made of component pieces, such as described in connection with FIG. 1, or may consist of a unitary structure, such as a slab of plywood or particleboard, for instance, or a metal composite material plate. The base table structure 110 may also be configured with optional benches 118 and 120 to provide seating to users of the apparatus when in either the home or active position.

The frame assembly 102 is pivotally connected to the base table structure 110 via a footer frame 122. The footer frame 122 is attached to an elongate mast housing 124. The elongate mast housing 124 carries a partial table surface 126 that comes to rest so that it is generally coplanar with the base table surface portions 114 and 116, with the elongate mast housing 124 positioned within a gap, as at 128. When transitioning between the apparatus active and home positions, the frame assembly 102 pivots about one or more lower pivot connection points, as at 130 and 132. While the footer frame 122 may be configured such that only one such connection point is needed, it is preferred that two or more are used for increased rigidity, stability, and safety.

The backboard 106 is rotatable with respect to the elongate mast housing 124 via its attachment to the mast 136. The mast 136 and elongate mast housing 124 are generally coaxial, and the mast 136 rotates freely within the hollow shaft bushing (not shown) mounted within the elongate mast housing 124. Fixation of the backboard 106 to the mast 136 can be carried out using any method that will fix the backboard 106 with respect to movement relative to the mast 136. FIG. 1 depicts the use of a bolt 138 and backboard flange 140, for instance.

The weight and positioning of the base table structure 110 relative to the frame assembly 102 provides a counterweight, or opposite moment, to moments resulting from forces applied to the frame assembly 102 when in the active position, as shown in FIG. 1, for instance. For example, players dunking the basketball may apply an impulse force to the rim 108, directed generally toward the ground, from time to time during the use of the apparatus. Such a force may result in a positive moment applied at the tipping edge 134, causing the apparatus to tend to tilt toward the basketball court. The weight of the base table structure 110 provides a countering moment to these and other tilt-causing moments to stabilize the device at all times. The base 110 may also conveniently provide an attachment point for various add-on features, such as a scorer's table, power systems, seats, and secondary table surfaces.

Figure 2:
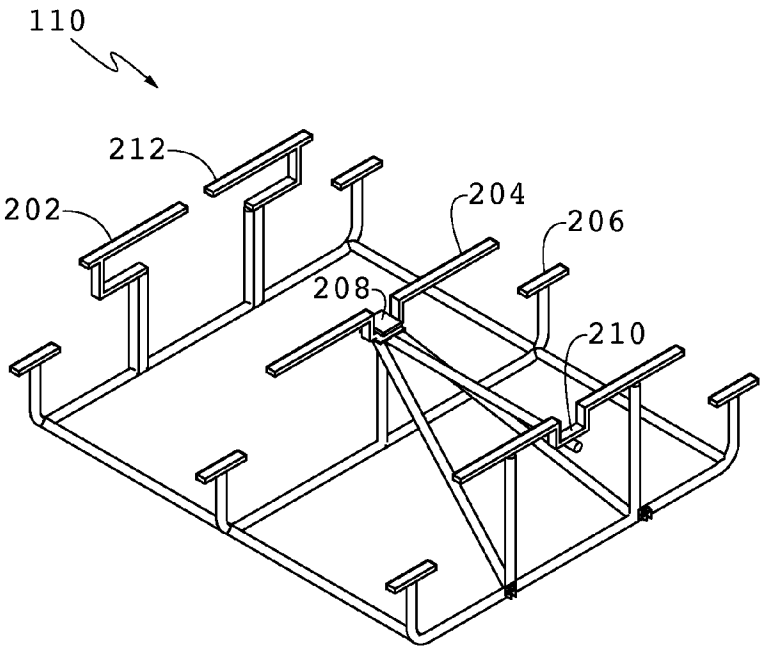
FIG. 2 shows an elevated front left perspective view of the frame portion of the base.

FIG. 2 is an elevated front left view of the structural frame portion of the base table structure 110. In a preferred embodiment of the invention, the structural frame of base 110 is constructed from lightweight hollow tubing composed of a material strong enough to support the weight of other base elements, participants seated at the table, and other objects placed onto the table surface. No particular claim is made to the type of material or exact configuration of the structural frame, and FIGS. 2 and 3 merely depict a configuration that is considered the best mode at the time of this disclosure. The structural frame should generally, however, include one or more table surface attachment points, as at 202 and 204, for instance. The table surface portions (shown in FIG. 1 as elements 114 and 116) are secured to these horizontal frame portions, thereby retaining them to the base 110. Bench surfaces (such as element 120 again in FIG. 1) may be secured to bench attachment points, as at 206 for instance, if so desired.

Figure 3:
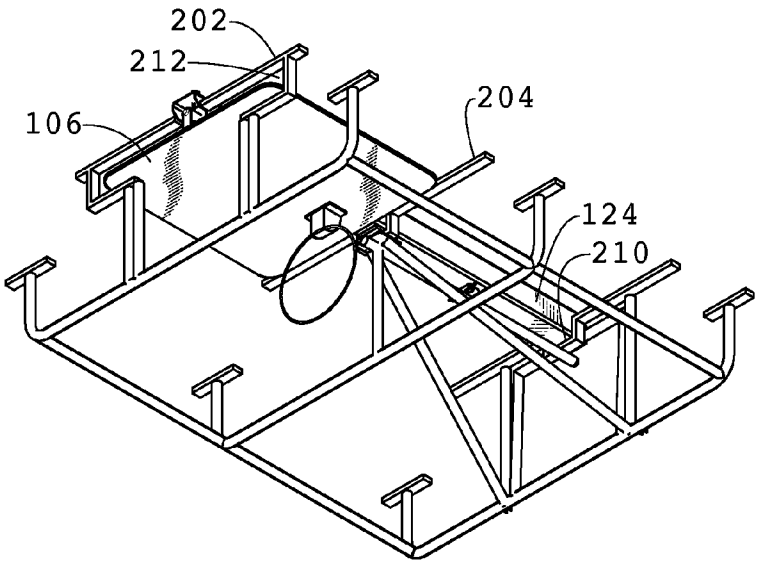
FIG. 3 shows a lower rear left perspective view of the frame portion of the base and the frame assembly in the home position.

Frame assembly cradle grooves 208 and 210 are configured so that when the frame assembly (not shown) is in the home position, the elongate mast portion rests in and is supported by the cradle grooves 208 and 210. Basketball goal assembly storage space 212 likewise provides space in which the backboard can be stored while in the home position. FIG. 3 is a lower left perspective view of the base structural frame with the frame assembly in its stored, or home position. The elongate mast housing 124 has been lowered and is supported by, for instance, cradle groove 210. The backboard 106 has been retracted into space 212 and in this storage position rests beneath the table surface attachment points 202 and 204.

Figure 4:
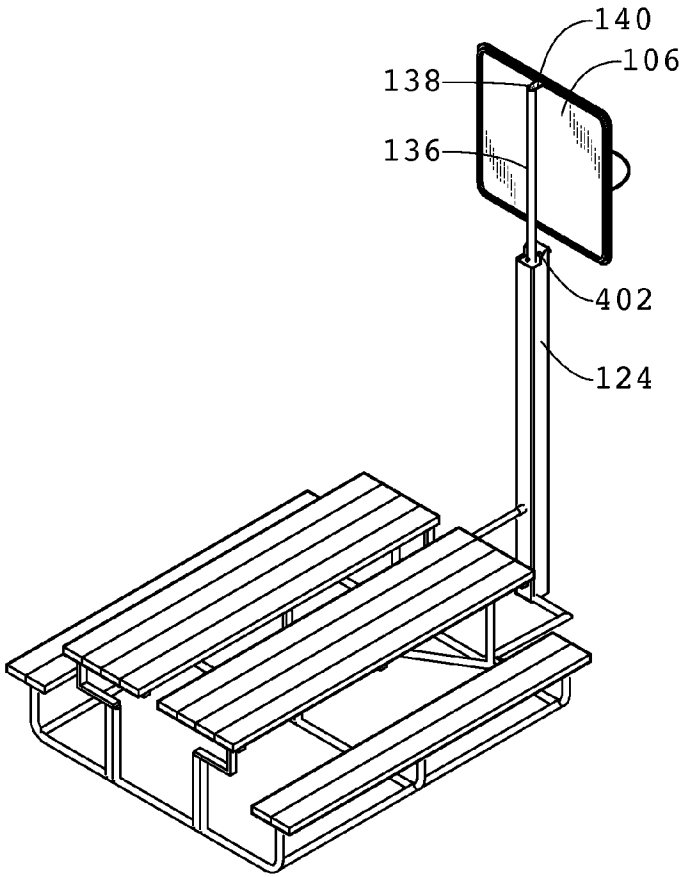
FIG. 4 shows an elevated rear left view of a preferred embodiment of the apparatus in the active position.

Turning to FIG. 4, an elevated rear left perspective view of an embodiment is shown. The connection between the backboard 106 and mast 136 is more easily seen in FIG. 4, wherein a bolt 138 and backboard flange 140 are shown as the method of securing the backboard 106 to the mast 136. The mast 136, in turn, extends downwardly into the distal end 402 of the elongate mast housing 124, fitting into a hollow shaft bushing (not shown) secured in the interior of the elongate mast housing 124. The hollow shaft bushing and mast 136 together create a surface bearing, allowing the mast 136 to experience rotational and linear motion with respect to the hollow shaft bushing and elongate mast housing 124.

Figure 5:
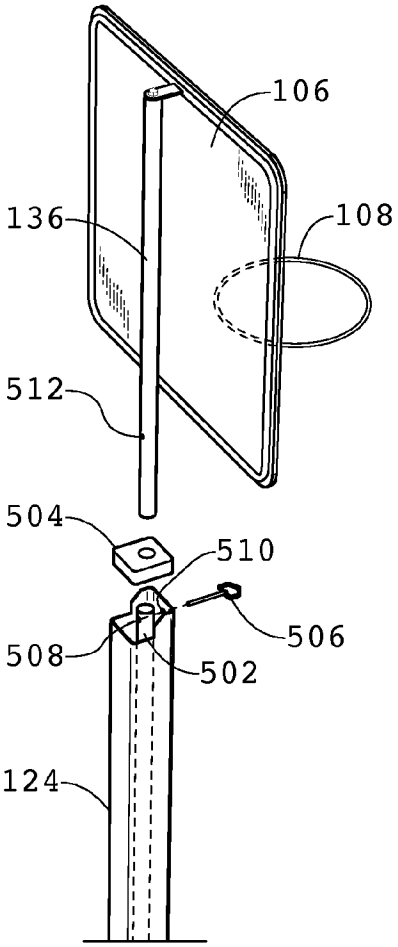
FIG. 5 shows an exploded view of the frame assembly and basketball goal assembly connection shown in FIG. 4.

The hollow shaft bushing 502 is seen in FIG. 5, and extending downwardly in the elongate mast housing 124. The hollow shaft bushing 502 is mounted within the elongate mast housing 124 by a plurality of mounting retainers 504 spaced apart along the length of the hollow shaft bushing 502. The mounting retainers 504 are secured to the hollow shaft bushing 502 so that there is no relative movement between the retainers and the bushing 502. As seen in FIG. 5, a square shaped elongate mast housing 124 and appropriately sized mounting retainer 504 will allow the insertion of the hollow shaft bushing 502 into the elongate mast housing 124 while preventing bushing rotation with respect to the elongate mast housing 124. The best mode of attachment at the time of this disclosure is to use three such mounting retainers. Other methods of mounting are available to those skilled in the art depending on the particular application, but the hollow shaft bushing 504 should be mounted within the elongate mast housing 124 in such a manner as to allow rotational and linear movement of the mast 136 with respect to the bushing 502.

A retaining pin 506 is used to fix the rotational and linear position of the mast 136 with respect to the elongate mast housing 124 and/or the hollow shaft bushing 502. One or more frame assembly retaining pin holes are drilled into either or both of the hollow shaft bushing 502, as at 508, and an exterior surface of the elongate mast housing 124, as at 510, for instance. One or more mast retaining pin holes, for instance hole 512, are drilled into the mast 136. By aligning the one or more frame assembly retaining pin holes 508 and 510 with a mast retaining pin hole 512 and inserting the retaining pin 506, the user can select the height of the rim 108 with respect to the ground and prevent rotation of the backboard 106 about the mast 136 axis. Multiple mast retaining pin holes spaced along the mast 136 will permit for a variety of rim height adjustments, permitting desired flexibility in the rim playing height.

Figure 8:
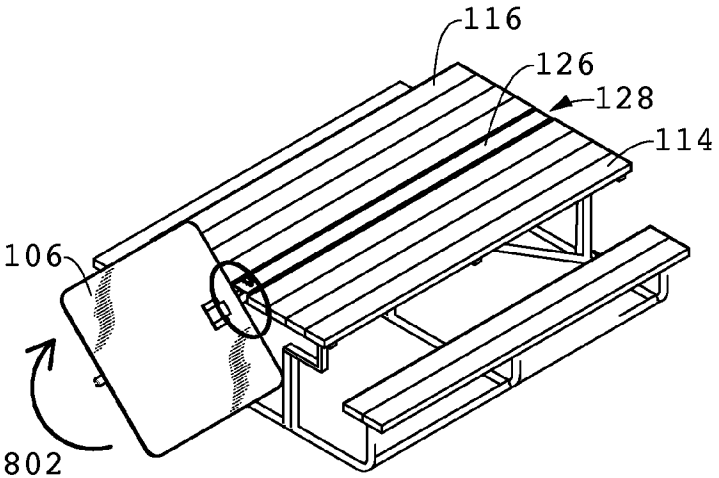
FIG. 8 shows an elevated perspective view of the embodiment shown in FIG. 6 in which the basketball goal assembly is in a transition between the open and closed positions.
Figure 9:
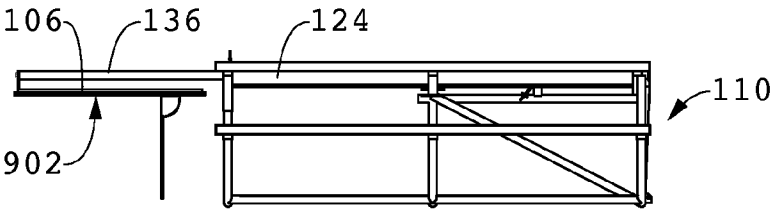
FIG. 9 shows a side view of the embodiment shown in FIG. 6 in which the basketball goal assembly has been rotated for storage, but not retracted into the closed position.
Figure 6:
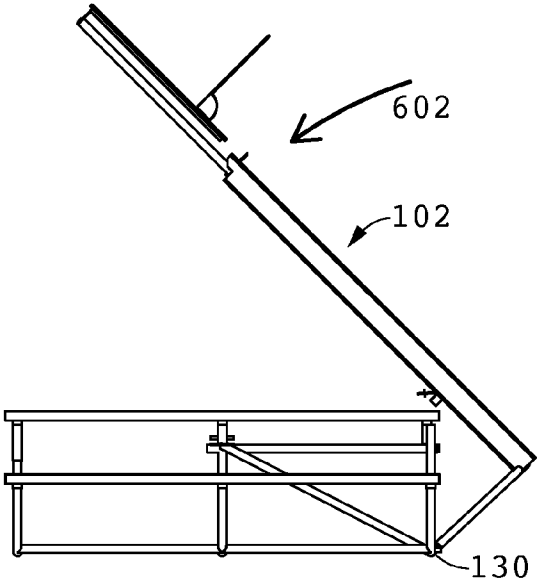
FIG. 6 shows a side view of a preferred embodiment of the apparatus in a transition state between the home and active positions.
Figure 7:
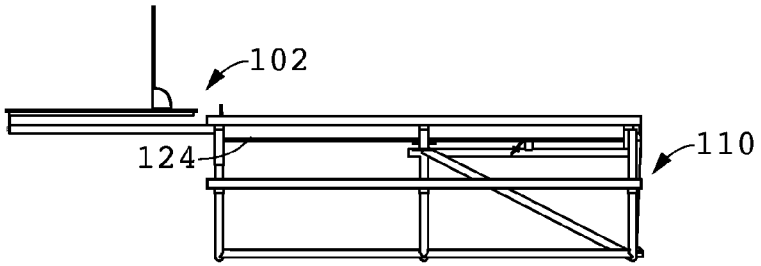
FIG. 7 shows a side view of the embodiment shown in FIG. 6 in which the frame assembly is lowered for storage and the basketball goal assembly is in the open position.

FIGS. 6 through 10 generally depict a transition from the active position to the home position. In FIG. 6, the frame assembly 102 is pivoted around the lower pivot connection points 130 (132 not shown) in the direction of arrow 602. FIG. 7 depicts the apparatus when the frame assembly 102 has been lowered onto the base such that the elongate mast housing 124 is positioned in gap 128 (not shown). An elevated upper right perspective view is shown in FIG. 8, in which the backboard 106 and mast have been rotated in the direction of arrow 802. No particular direction is considered better than the other; counterclockwise rotation of the backboard 106 is also possible. Note that FIG. 8 depicts the position of the elongate mast housing 124 in gap 128 as shown in FIG. 7, wherein the partial table surface 126 rests between and is generally coplanar with the base table surface portions 114 and 116, thereby forming a complete table surface.

FIG. 9 is again a side view of the embodiment shown in FIG. 1 in which the apparatus has progressed toward the home position. The backboard 106 has been rotated a full 180 degrees from its position shown in FIG. 7 such that the front playing surface 902 now faces downward toward the ground. The mast 136 remains fully extended with respect to the elongate mast housing 124, or in cases of differing apparatus sizes, the mast 136 is at least extended to a degree that will allow the backboard 106 to avoid contact with the base 110 as the frame assembly 102 is in the process of being raised or lowered.

Figure 10:
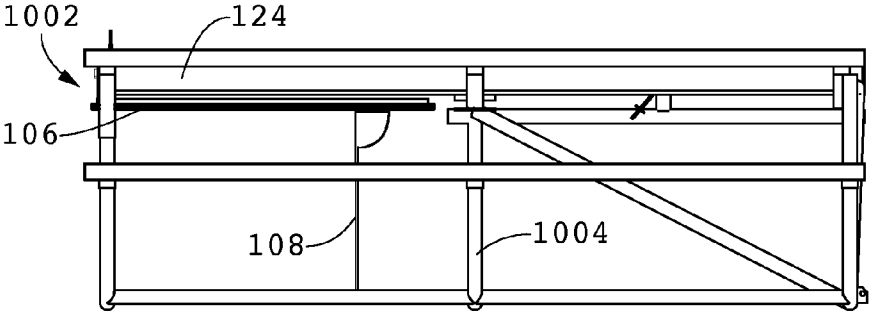
FIG. 10 shows a side view of the embodiment shown in FIG. 6 in the fully stored, home position.

FIG. 10 depicts the apparatus in the fully stored home position. From FIG. 9, the backboard 106 and mast (not shown) are pushed in the direction of arrow 1002 until the mast is fully retracted and the backboard 106 is protected and stored as shown in FIG. 10. The rim 108 comes to rest near the center table supports, for example support 1004, thereby protecting the rim from damage and storing it in a manner that decreases its obtrusiveness with respect to the use of the apparatus as a table when in the home position.

Figure 11:
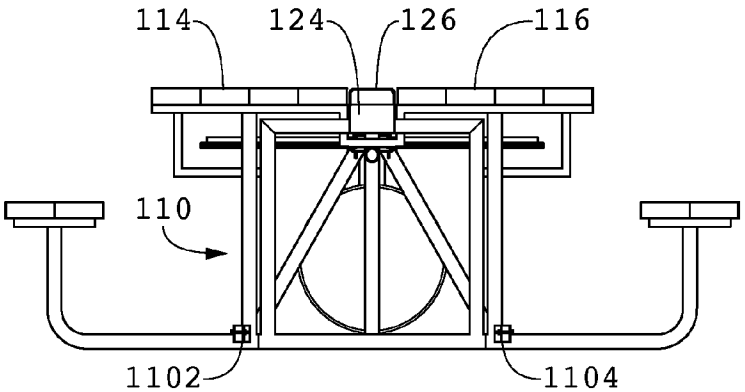
FIG. 11 shows a back view of the embodiment shown in FIG. 10.

FIG. 11 depicts a front view of the embodiment shown in FIG. 10 of the apparatus in the home position. Note that when the elongate mast housing 124 rests on the base 110 when in the home position, the partial table surface 126 forms a complete table surface by filling the gap between the base table surface portions 114 and 116. FIG. 11 also depicts two removable wheel slots 1102 and 1104 into which removable and storable caster-type wheels (not shown) may be inserted to ease the task of moving the apparatus. By slightly lifting the front end of the apparatus, attachment stubs extending from the caster wheel axles can be inserted into the removable wheel sleeves 1102 and 1104, enabling a user to lift the rear end of the apparatus off of the ground and easily move the apparatus. Preferably, the system with wheels installed can be moved by one person across a hard surface, or towed by a small garden tractor across turf.

Figure 12:
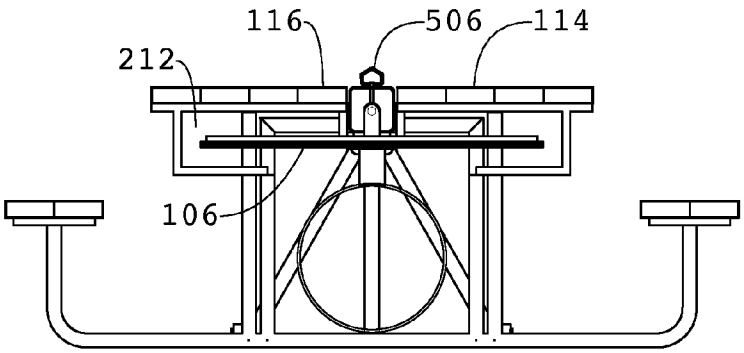
FIG. 12 shows a front view of the embodiment shown in FIG. 10.

FIG. 12 is a rear view of the embodiment shown in FIG. 10 depicting the space 212 into which the backboard 106 is stored when the apparatus is in the home position. The retaining pin 506 is inserted into the frame assembly pin holes and the corresponding mast retaining pin hole that locks the rotation of the backboard 106 and sets the mast and backboard 106 into a fully retracted position for storage in the home position. The retaining pin 506 may optionally have a handle that can be folded down to table surface level in order to provide for little table surface obstruction. An optional retaining pin cover or cap (not shown) may also be provided to hide the retaining pin 506 from view and provide a more uniform surface when the apparatus is in the home position and is being used as a table.

Figure 14:
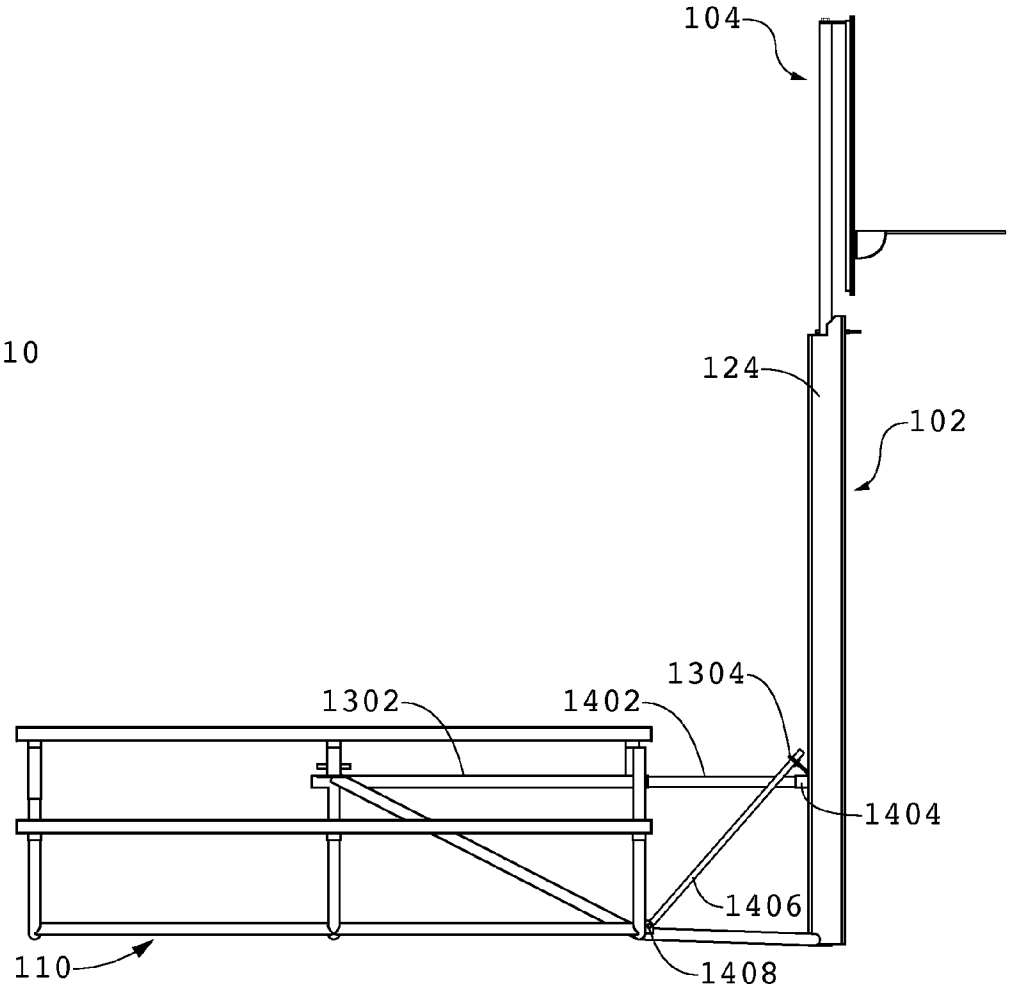
FIG. 14 shows a side view of a preferred embodiment using a wishbone support for increased stability and safety.
Figure 13:
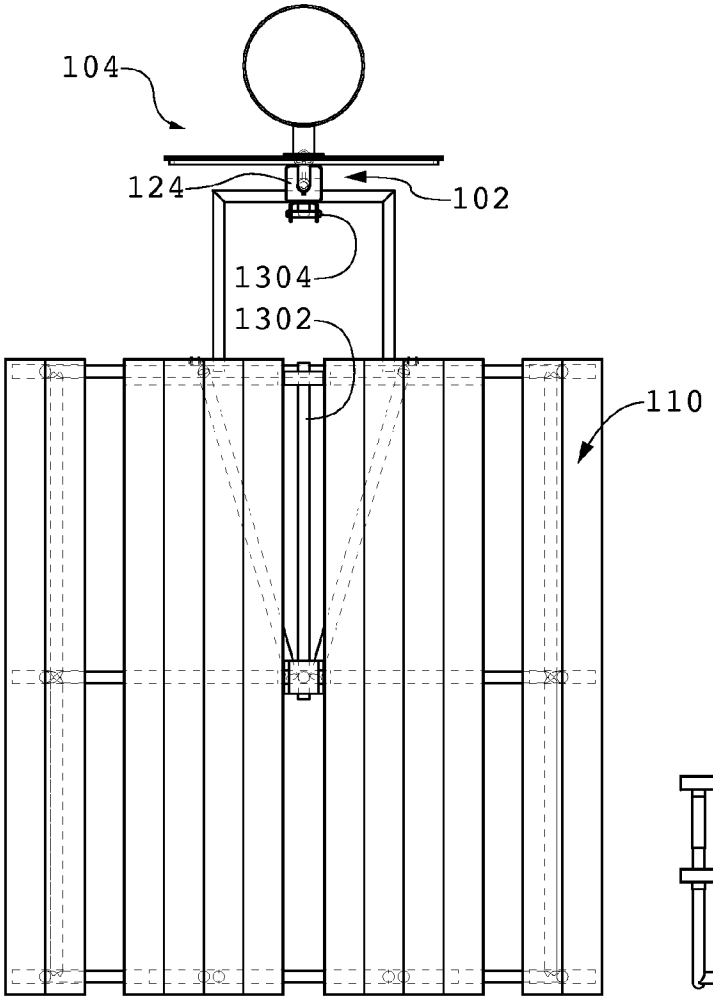
FIG. 13 shows a top view of an embodiment in the active position without reinforcing support members attached.
Figure 16:
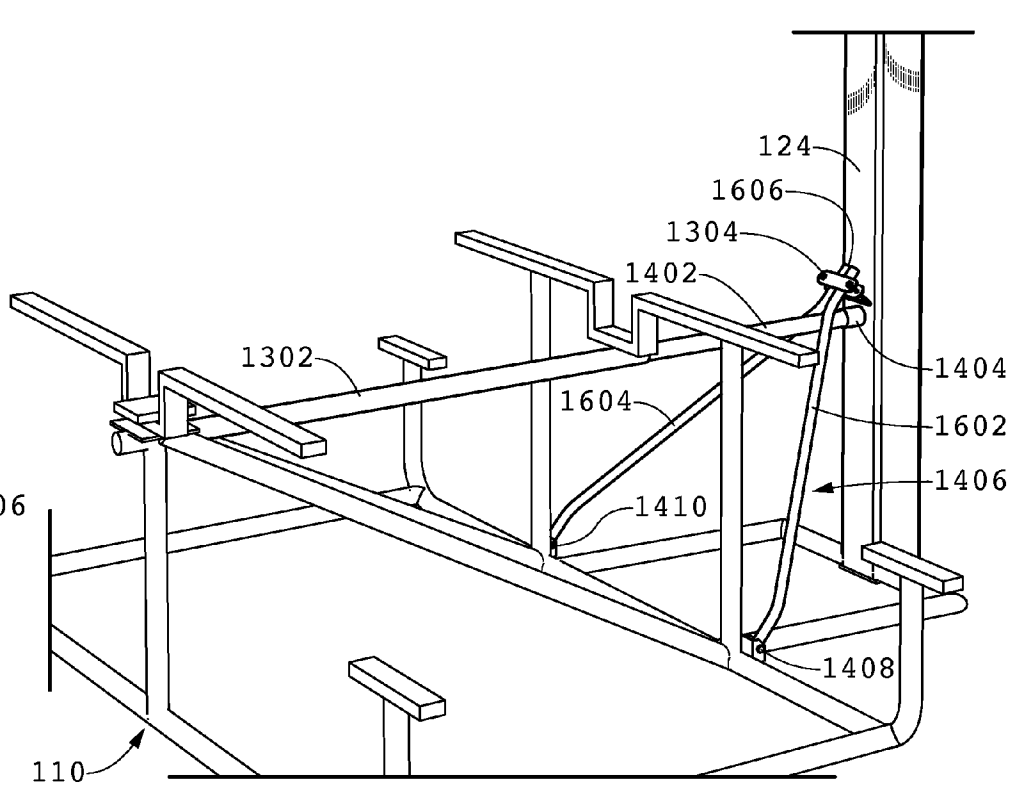
FIG. 16 shows a cutaway perspective view of the use of a wishbone support and telescoping support shown in FIG. 14.
Figure 15:
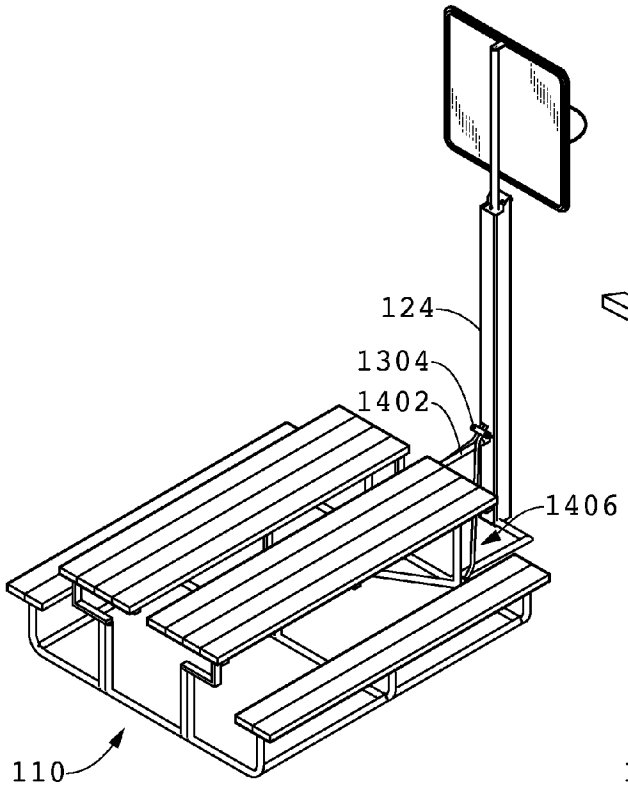
FIG. 15 shows an elevated rear left view of the embodiment shown in FIG. 14.

FIGS. 13 through 16 generally depict the use of optional but preferred structural supports that increase the strength, stability, and safety of the apparatus. FIG. 13 is a top view of the apparatus after the basketball goal assembly 104 has been placed in the open position and the frame assembly 102 has been raised into the active position. FIGS. 14 and 15 are a left side view and elevated left rear view, respectively, of the apparatus in the active position after the installation or engagement of the optional structural supports. FIG. 16 is a cut away detailed view of the structural supports shown in FIGS. 14 and 15.

The telescoping support consists of a fixed portion 1302 and a telescoping portion 1402, the latter of which fits within the former during storage. After the apparatus is transitioned to the active position, the user can extend the telescoping portion 1402 until it reaches the telescoping support attachment point 1404 on the elongate mast housing 124. The fixed portion 1302 is secured to the base 110 frame portion (shown in dotted lines in FIG. 13) and remains fixed with respect to the base 110 at all times. The distal end of the telescoping portion 1402 is configured to securably connect to the frame assembly 102 in such a manner so as to prevent rotational movement of the frame assembly 102 about its lower pivot point(s) with the base 110. For example, the distal end of the telescoping portion 1402 may be threaded and screwed into the telescoping support attachment point 1404 that is configured with receiving threads. Alternatively, a pin and through hole method of attachment can be used, as well as any other method which accomplishes the goal of restricting frame assembly motion about the lower pivot point(s).

A wishbone-type support 1406 may also be utilized alone or in conjunction with the telescoping support. The wishbone support 1406 reinforces and stabilizes the apparatus when in the active position by restricting side-to-side movement of the frame assembly 102. The wishbone support 1406 is comprised of a left support member 1602 and right support member 1604. The proximal end of the left support member 1602 attaches to the base 110 at connection 1408, and the proximal end of the right support member 1604 attaches to the base 110 at connection 1410. The distal ends of the left and right support members are mated, as at 1606, and are secured to the frame assembly 102 at a convenient connection point 1304. The wishbone support configuration is considered a best mode of restricting swaying movement in the frame assembly 102 due to its lightweight and force transmitting characteristics. However, any particular support design that connects the frame assembly 102 with the base 110 in a manner that restricts lateral swaying or side-to-side movement of the frame assembly 102 is considered encompassed by the current disclosure, as those skilled in the art of mechanical design shall recognize.

Figure 17:
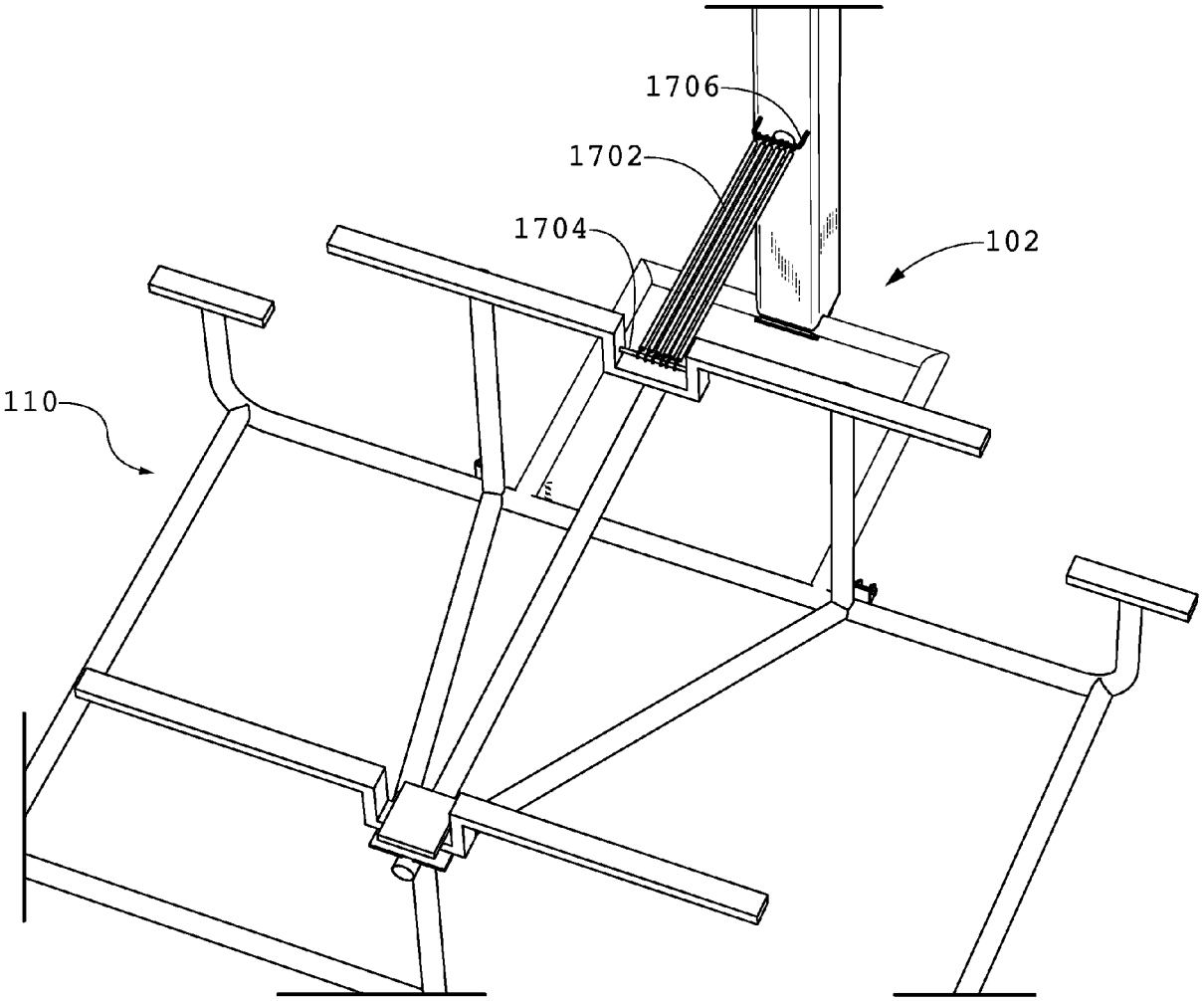
FIG. 17 shows a cutaway elevated perspective view of an embodiment employing a plurality of elastic bands as a force assist mechanism.
Figure 19:
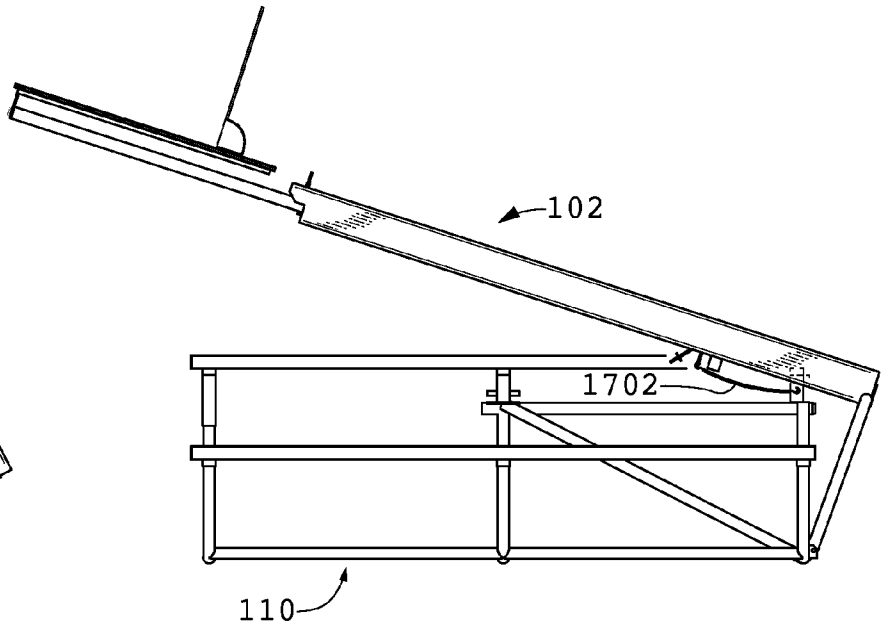
FIG. 19 shows a side view of the embodiment shown in FIG. 18 depicting the use of a force assist mechanism.
Figure 18:
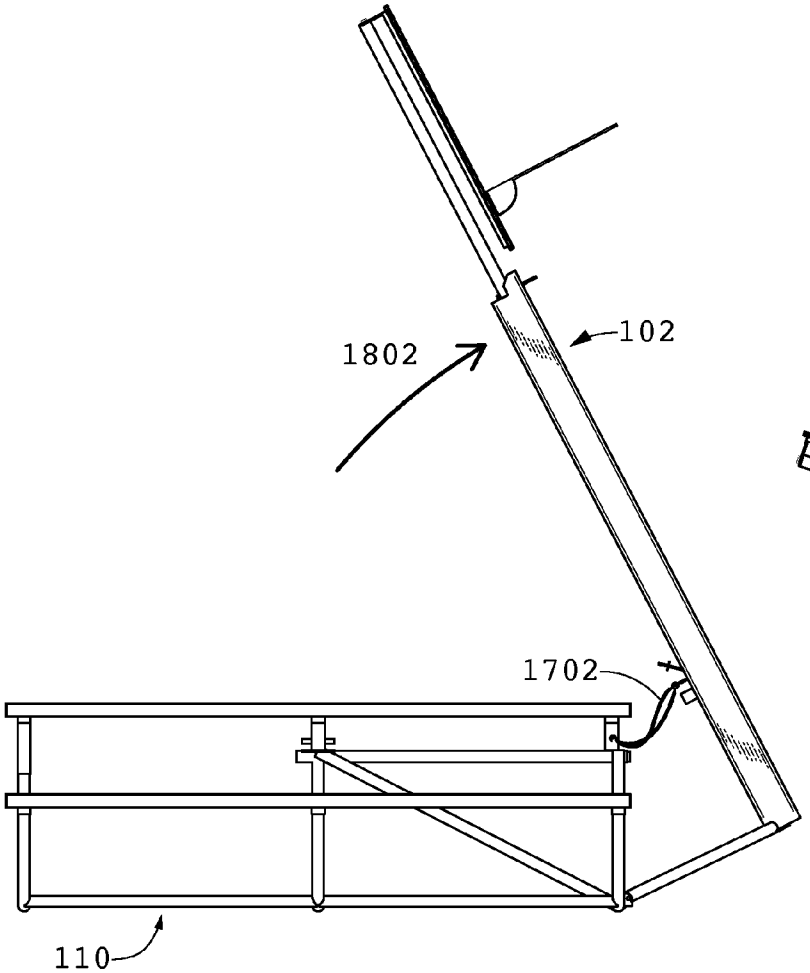
FIG. 18 shows a side view of an embodiment employing a force assist mechanism depicting its use during the transition between home and active positions.

Turning to FIGS. 17 through 19, a preferred embodiment of the apparatus utilizing a force assist mechanism is shown. The best mode of such force assist mechanisms is considered to be a plurality of elastic bands 1702 secured to the base 110 and frame assembly 102 so that the force exerted by the plurality of elastic bands when in tension operates to assist the user of the apparatus when lifting the frame assembly 102 from the base 110 to transition to the active position, as well as when lowering the frame assembly 102 to the base 110 to transition to the home position. It should be evident to those skilled in the art that any method of providing force assistance to the user when transitioning between positions can be employed in a similar manner. The elastic band method depicted in FIGS. 17 through 19 is consider the best mode because of the low cost and light weight of the elastic bands.

FIG. 17 depicts an exemplary force assist method using a plurality of elastic bands 1702. Each individual elastic band in the group 1702 exerts a contractive force when in tension that is based on its material properties, diameter, and the length that it has been extended due to tension. By utilizing a plurality of elastic bands that are coterminous at a base connection point 1704 and a frame assembly connection point 1706, the assistive forces can be increased without increasing the diameter of the elastic bands, thereby effectively utilizing the horizontal space available within the frame elongate mast housing receiving gap. A single elastic band may also be used, as desired.

When the frame assembly 102 is moved beyond the position shown in FIG. 18 in the direction of arrow 1802, the forces exerted by the plurality of elastic bands 1702 will increase under tension. Thus, as the frame assembly 102 is lifted into the active position (in the direction of arrow 1802), the elastic bands 1702 will apply an increasing force against the direction of the frame assembly's movement, helping the user to keep the frame assembly 102 from falling to the ground too quickly. Likewise, the tension existing in the elastic bands 1702 when the apparatus is completely in the active position will reduce the amount of force needed to rotate the frame assembly 102 back towards its resting position on the base 110.

FIG. 19 depicts the force assist mechanism application when the frame assembly 102 is near the home position, where it rests on the base 110. Much as in FIG. 18, but generally in the opposite direction, the elastic bands 1702 assist the user when lifting the frame assembly 102 off of the base 110 in order to transition to the active position. The elastic bands 1702 also provide force to slow the descent of the frame assembly 102 into the gap and its resting place in the base 110 when preparing the apparatus for storage or table mode use.

In addition to the use of a plurality of elastic bands, other methods of force assistance are available to those skilled in the art when making or using the invention. For example, simple gas cylinders could be utilized to assist the user when transitioning between modes of use, and to control the speed of the frame assembly as it nears the new position. Alternatively, the use of a spring tension assembly as disclosed in U.S. patent application Ser. No. 13/009,139 is also considered a preferred method of providing effective force assistance. A method of providing force assistance using a tensioned spring assembly would be useful, for instance, wherein a spring under tension is connected to both the base structural frame and the frame assembly such that it exerts a constant linear unwinding force in the direction of rotation required for lifting the frame assembly into the active position. The assistive lifting force diminishes as the frame assembly is raised and the spring is thereby unwound. Likewise, the counter-motion force increases as the frame assembly is lowered into the home position, providing assistive force to cushion the frame assembly's descent.

The object disclosed provides for a basketball goal that is foldable from a home position to an active position, wherein the apparatus may be utilized both as a basketball goal and as a sports table. Various lifting and extending mechanisms are applied to the structure to further assist in the transition between these positions, and to provide convenience, stability, and safety to the apparatus. The descriptions of these mechanisms are not meant to be limiting, but to allow those skilled in the art to make and use the invention. Analogous mechanisms known in the art are considered enabled by the above disclosure of the design considerations and possibilities. Additionally, more robust force assist mechanisms can be applied to automate the transition between use modes, such as electrically driven screws, hydraulic pistons, and the like. It is, however, preferred that the force assist mechanisms be simple and lightweight.

Further additions to the invention may also be made without departing from the object of the disclosure. For instance, basketball games are often played with time limits, or to a predetermined score. To make the use of the invention more convenient for those playing basketball, elements may be added to assist in time keeping or score keeping. Lighted scoring or time keeping systems known in the art may be mounted on the apparatus and powered by a power source external to or mounted on the apparatus. Such systems could be mounted on the basketball goal assembly, the frame assembly, or the base. The rim could be provided with an optical or mechanical indicator to determine when a basketball goal is scored. Scores may be indicated with a light, audible signal, or may be automatically recorded on a scorekeeping device.

At parks, homes, and other outdoor areas, tables are often placed in the vicinity of basketball goals for spectators or players' drinks and belongings. The base table surface portions (e.g., 114 and 116 in FIG. 1) serves, when the apparatus is in the active position, as a table for those not playing, those operating a scoring display, or for other such uses.

A lighting system may also be provided so as to facilitate basketball games in low lighting circumstances. For example, floodlights could be mounted at the pinnacle of the basketball goal assembly to illuminate the basketball court at night. The power source may be electric, hydraulic, or other such sources, as previously indicated. Electric storage systems now known or later developed could be used to store solar energy in the form of electrical energy, to be used with the additional convenience components, the lifting mechanisms, or both.

Additionally, other games commonly played on a flat table-like surface may be provided with the apparatus and stored in optional storage benches. For example, board games or card games could be stored in the hollow benches provided as part of the apparatus base. Other sports games, such as table tennis, may be played on the table surface when the apparatus is in the home position. Paddles, balls, and a net may be stored in a like manner. Those skilled in the art could easily modify the tabletop frame portion of the apparatus to be mounted with the table tennis net. These and other such uses of and additions to the apparatus are envisioned as being alternate embodiments of the invention as described herein.

While the invention has been described with reference to preferred embodiments, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Since certain changes may be made in the above compositions and methods without departing from the scope of the invention herein involved, it is intended that all matter contained in the above descriptions and examples or shown in the accompanying drawings shall be interpreted as illustrative and not in a limiting sense. In this application all units are in the metric system and all amounts and percentages are by weight, unless otherwise expressly indicated. Also, all citations referred herein are expressly incorporated herein by reference. All terms not specifically defined herein are considered to be defined according to Webster's New Twentieth Century Dictionary Unabridged, Second Edition. The disclosures of all of the citations provided are being expressly incorporated herein by reference. The disclosed invention advances the state of the art and its many advantages include those described and claimed.

We claim:

1. A basketball goal apparatus transitionable between an active position and a home position, comprising:

a. a base table structure comprising:

i. a basketball goal assembly storage space positioned vertically beneath the one or more table surface attachment points at a base table structure distal end; and ii. a lower pivot connection point at a base table structure proximal end;

b. a frame assembly comprising:

i. an elongate mast housing having a partial table surface and an axis centered along the length of the elongate mast housing and oriented parallel to the partial table surface, a proximal end, and a distal end; and ii. a footer frame affixed to the proximal end of the elongate mast housing and pivotally secured to the base table structure at the lower pivot connection point; and c. a basketball goal assembly comprising:

i. a mast slidably and rotatably mounted within the elongate mast housing, wherein the mast is rotatable at least 180 degrees about the elongate mast housing axis and extendable outwardly from the distal end of the elongate mast housing along the elongate mast housing axis;

ii. a backboard affixed to the mast and having a front playing surface and a rear surface; and iii. a rim affixed to the backboard;

the basketball goal assembly being transitionable between:

a closed position, wherein the mast is rotated so that the front playing surface is oriented in a plane parallel to the partial table surface and faces in an opposite direction, and the mast is fully retracted such that the backboard is positioned within the basketball goal assembly storage space, and an open position, wherein the rim is accessible for playing basketball;

said apparatus home position comprising the basketball goal assembly oriented in the closed position and the frame assembly pivoted so that the elongate mast housing is generally horizontally disposed, with the base providing support to the frame assembly, and said apparatus active position comprising the basketball goal assembly oriented in the open position and the frame assembly pivoted so that the elongate mast housing is generally vertically disposed, with the base acting as a counterweight to the frame assembly.

2. The basketball goal apparatus of claim 1, further comprising a force assist mechanism connected to both the base and the frame assembly for reversibly providing force assistance when transitioning the apparatus between the home and active positions.

3. The basketball goal apparatus of claim 2, the force assist mechanism further comprising an elastic band having a proximal end connected to the base and a distal end connected to the frame assembly.

4. The basketball goal apparatus of claim 2, the force assist mechanism further comprising a plurality of elastic bands, each having a diameter and being coterminous with respect to the other elastic bands at a base connection point and a frame assembly connection point such that the amount of force exerted by the plurality of elastic bands during a transition between the home and active positions is the sum of the force exerted by each elastic band in the plurality of elastic bands, thereby enabling a larger amount of force to be utilized without increasing the diameter of the elastic bands.

5. The basketball goal apparatus of claim 1, the frame assembly further comprising a hollow shaft bushing having an internal surface, the hollow shaft bushing being rotatably and linearly fixed with respect to the elongate mast housing by a plurality of mounting retainers positioned and spaced apart along the elongate mast housing axis; and the mast further comprising an external surface, wherein the mast is mounted within the internal surface such that the mast is coaxial, slidable and rotatable with respect to the shaft bushing, and the mast external surface and shaft bushing internal surface form a bearing surface.

6. The basketball goal apparatus of claim 5, further comprising:

a. a frame assembly retaining pin hole in either or both of the elongate mast housing and the hollow shaft bushing;

b. one or more mast retaining pin holes spaced at intervals along the external surface of the mast such that each of the one or more mast retaining pin holes correspond to a discrete rim height when positioned through sliding or rotation of the mast to be coaxial with the frame assembly retaining pin hole; and c. a retaining pin removably insertable through the frame assembly retaining pin hole and a mast retaining pin hole selected from the one or more mast retaining pin holes wherein the selected mast retaining pin hole is positioned to be coaxial with the frame assembly pin hole, such that the retaining pin prevents linear movement of the mast along the elongate mast housing axis.

7. The basketball goal apparatus of claim 6, further comprising a telescoping support having:

a fixed portion secured to the base table structure; and a telescoping portion extendable outwardly from the base table structure and having a distal end such that the distal end of the telescoping portion contacts and is securable to the frame assembly when the apparatus is in the active position, wherein the connection of the telescoping support to the frame assembly when the apparatus is in the active position prevents rotational motion by the frame assembly about the lower pivot point.

8. The basketball goal apparatus of claim 6, further comprising a wishbone support having:

left and right support members oriented in a wishbone configuration and each having a proximal end and a distal end, wherein the left support member proximal end is spaced apart from the right member proximal end, and wherein the left support member distal end is mated to the right support member distal end, said left and right support member proximal ends each being securable to the base table structure, and said mated left and right support member distal ends forming a connection point securable to the elongate mast housing, wherein the frame assembly is buttressed against lateral forces with respect to the elongate mast housing axis when the apparatus is in the active position.

9. The basketball goal apparatus of claim 1, the base further comprising two benches attached to the base thereby providing seating.

10. The apparatus of claim 1 wherein removable wheels are provided allowing the apparatus to be moved across a surface to a desired location.

11. A basketball goal apparatus transitionable between an active position and a home position, comprising:

a. a base table structure comprising:

i. one or more base table surface portions;

ii. a structural frame having one or more table surface attachment points onto which the one or more base table surface portions are secured;

iii. one or more frame assembly cradle grooves;

iv. a basketball goal assembly storage space positioned vertically beneath the one or more table surface attachment points; and v. a lower pivot connection point;

b. a frame assembly comprising:

i. an elongate mast housing having a partial table surface and an axis centered along the length of the elongate mast housing and oriented parallel to the partial table surface, a proximal end, and a distal end; and ii. a footer frame affixed to the proximal end of the elongate mast housing and pivotally secured to the base table structure at the lower pivot connection point; and c. a basketball goal assembly comprising:

i. a mast slidably and rotatably mounted within the elongate mast housing, wherein the mast is rotatable at least 180 degrees about the elongate mast housing axis and extendable outwardly from the distal end of the elongate mast housing along the elongate mast housing axis;

ii. a backboard affixed to the mast and having a front playing surface and a rear surface; and iii. a rim affixed to the backboard;

the basketball goal assembly being transitionable between:

a closed position, wherein the mast is rotated so that the front playing surface is oriented in a plane parallel to the partial table surface and faces in an opposite direction, and the mast is fully retracted such that the backboard is positioned within the basketball goal assembly storage space, and an open position, wherein the rim is accessible for playing basketball;

said apparatus home position comprising the basketball goal assembly oriented in the closed position and the frame assembly pivoted so that the elongate mast housing is generally horizontally disposed, with the one or more frame assembly cradle grooves providing support to the frame assembly, and said apparatus active position comprising the basketball goal assembly oriented in the open position and the frame assembly pivoted so that the elongate mast housing is generally vertically disposed, with the base acting as a counterweight to the frame assembly.

12. The basketball goal apparatus of claim 11, the frame assembly further comprising a hollow shaft bushing having an internal surface, the hollow shaft bushing being rotatably and linearly fixed with respect to the elongate mast housing by a plurality of mounting retainers positioned and spaced apart along the elongate mast housing axis; and the mast further comprising an external surface, wherein the mast is mounted within the internal surface such that the mast is coaxial, slidable and rotatable with respect to the shaft bushing, and the mast external surface and shaft bushing internal surface form a bearing surface.

13. The basketball goal apparatus of claim 12, further comprising:

a. a frame assembly retaining pin hole in either or both of the elongate mast housing and the hollow shaft bushing;

b. one or more mast retaining pin holes spaced at intervals along the external surface of the mast such that each of the one or more mast retaining pin holes correspond to a discrete rim height when positioned through sliding or rotation of the mast to be coaxial with the frame assembly retaining pin hole; and c. a retaining pin removably insertable through the frame assembly retaining pin hole and a mast retaining pin hole selected from the one or more mast retaining pin holes wherein the selected mast retaining pin hole is positioned to be coaxial with the frame assembly pin hole, such that the retaining pin prevents linear movement of the mast along the elongate mast housing axis.

14. The basketball goal apparatus of claim 13, further comprising:

a. a telescoping support having:

i. a fixed portion secured to the base table structure; and ii. a telescoping portion extendable outwardly from the base table structure and having a distal end such that the distal end of the telescoping portion contacts and is securable to the frame assembly when the apparatus is in the active position, wherein the connection of the telescoping support to the frame assembly when the apparatus is in the active position prevents rotational motion by the frame assembly about the lower pivot point; and b. a wishbone support having left and right support members oriented in a wishbone configuration and each having a proximal end and a distal end, wherein the left support member proximal end is spaced apart from the right member proximal end, and wherein the left support member distal end is mated to the right support member distal end, said left and right support member proximal ends each being securable to the base table structure, and said mated left and right support member distal ends forming a connection point securable to the elongate mast housing, wherein the frame assembly is buttressed against lateral forces with respect to the elongate mast housing axis when the apparatus is in the active position.

15. A basketball goal apparatus transitionable between an active position and a home position, comprising:

a. a base table structure comprising:

i. one or more base table surface portions;

ii. a structural frame having one or more table surface attachment points onto which the one or more base table surface portions are secured;

iii. one or more frame assembly cradle grooves;

iv. a basketball goal assembly storage space positioned vertically beneath the one or more table surface attachment points; and v. a lower pivot connection point;

b. a frame assembly comprising:

i. an elongate mast housing having a partial table surface and an axis centered along the length of the elongate mast housing and oriented parallel to the partial table surface, a proximal end, and a distal end; and ii. a footer frame affixed to the proximal end of the elongate mast housing and pivotally secured to the base table structure at the lower pivot connection point; and c. a basketball goal assembly comprising:

i. a mast slidably and rotatably mounted within the elongate mast housing, wherein the mast is rotatable at least 180 degrees about the elongate mast housing axis and extendable outwardly from the distal end of the elongate mast housing along the elongate mast housing axis;

ii. a backboard affixed to the mast and having a front playing surface and a rear surface; and iii. a rim affixed to the backboard;

the basketball goal assembly being transitionable between:

a closed position, wherein the mast is rotated so that the front playing surface is oriented in a plane parallel to the partial table surface and faces in an opposite direction, and the mast is fully retracted such that the backboard is positioned within the basketball goal assembly storage space, and an open position, wherein the rim is accessible for playing basketball;

d. a telescoping support having:

i. a fixed portion secured to the base table structure; and ii. a telescoping portion extendable outwardly from the base table structure and having a distal end such that the distal end of the telescoping portion contacts and is securable to the frame assembly when the apparatus is in the active position, wherein the connection of the telescoping support to the frame assembly when the apparatus is in the active position prevents rotational motion by the frame assembly about the lower pivot point; and e. a wishbone support having left and right support members oriented in a wishbone configuration and each having a proximal end and a distal end, said apparatus home position comprising the basketball goal assembly oriented in the closed position and the frame assembly pivoted so that the elongate mast housing is generally horizontally disposed, with the one or more frame assembly cradle grooves providing support to the frame assembly, and said apparatus active position comprising the basketball goal assembly oriented in the open position and the frame assembly pivoted so that the elongate mast housing is generally vertically disposed, with the base acting as a counterweight to the frame assembly.

wherein the left support member proximal end is spaced apart from the right member proximal end, and wherein the left support member distal end is mated to the right support member distal end, said left and right support member proximal ends each being securable to the base table structure, and said mated left and right support member distal ends forming a connection point securable to the elongate mast housing, wherein the frame assembly is buttressed against lateral forces with respect to the elongate mast housing axis when the apparatus is in the active position.

16. The basketball goal apparatus of claim 15, further comprising a force assist mechanism for reversibly providing force assistance when transitioning the apparatus between the home and active positions, wherein the force assist mechanism is selected from the group consisting of:

a. an electromechanical actuator secured to the base and further having an extendable end secured to the frame assembly such that the actuation of the electromechanical actuator lifts the frame assembly into the active position from the home position and lowers the frame assembly into the home position from the active position;

b. a tensioned spring assembly having a spring under tension and connected to both the base structural frame and the frame assembly such that it exerts a constant linear unwinding force in the direction of rotation required for lifting the frame assembly into the active position; or c. a plurality of elastic bands, each having a diameter and being coterminous with respect to the other elastic bands at a base connection point and a frame assembly connection point such that the amount of force exerted by the plurality of elastic bands during a transition between the home and active positions is the sum of the force exerted by each elastic band in the plurality of elastic bands, thereby enabling a larger amount of force to be utilized without increasing the diameter of the elastic bands.

17. The basketball goal apparatus of claim 16, the base further comprising two benches attached to the base thereby providing seating.

18. The apparatus of claim 16 wherein removable wheels are provided allowing the apparatus to be moved across a surface to a desired location.

19. The basketball goal apparatus of claim 15, further comprising:

a. a frame assembly retaining pin hole in either or both of the elongate mast housing and the hollow shaft bushing;

b. one or more mast retaining pin holes spaced at intervals along the external surface of the mast such that each of the one or more mast retaining pin holes correspond to a discrete rim height when positioned through sliding or rotation of the mast to be coaxial with the frame assembly retaining pin hole; and c. a retaining pin removably insertable through the frame assembly retaining pin hole and a mast retaining pin hole selected from the one or more mast retaining pin holes wherein the selected mast retaining pin hole is positioned to be coaxial with the frame assembly pin hole, such that the retaining pin prevents linear movement of the mast along the elongate mast housing axis.

20. The basketball goal apparatus of claim 15, further comprising a telescoping support having:

a fixed portion secured to the base table structure; and a telescoping portion extendable outwardly from the base table structure and having a distal end such that the distal end of the telescoping portion contacts and is securable to the frame assembly when the apparatus is in the active position, and is retained in position, wherein the connection of the telescoping support to the frame assembly when the apparatus is in the active position prevents rotational motion by the frame assembly about the lower pivot point or collapse of the extended goal.

* * * * *